US008705994B2

(12) United States Patent
Inoue

(10) Patent No.: US 8,705,994 B2
(45) Date of Patent: Apr. 22, 2014

(54) FIXING DEVICE AND IMAGE FORMING APPARATUS INCLUDING THE SAME

(75) Inventor: Keisuke Inoue, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 269 days.

(21) Appl. No.: 13/119,025

(22) PCT Filed: Aug. 19, 2009

(86) PCT No.: PCT/JP2009/064486
§ 371 (c)(1),
(2), (4) Date: Mar. 15, 2011

(87) PCT Pub. No.: WO2010/032580
PCT Pub. Date: Mar. 25, 2010

(65) Prior Publication Data

US 2011/0170891 A1 Jul. 14, 2011

(30) Foreign Application Priority Data

Sep. 16, 2008 (JP) ..... 2008-236531

(51) Int. Cl.
*G03G 15/20* (2006.01)

(52) U.S. Cl.
USPC ..... 399/67

(58) Field of Classification Search
USPC ..... 399/67, 320, 330, 331
See application file for complete search history.

(56) References Cited

U.S. PATENT DOCUMENTS 4,753,543 A 6/1988 Mochimaru et al.
5,138,379 A 8/1992 Kanazashi (Continued)

FOREIGN PATENT DOCUMENTS

CN 1540456 A 10/2004
CN 1763656 A 4/2006

(Continued)

OTHER PUBLICATIONS

Office Action (Preliminary Notice of Rejection) dated Sep. 13, 2011, issued in the corresponding Japanese Patent Application No. 2010-080020, and an English Translation thereof.

(Continued)

*Primary Examiner* — Walter L Lindsay, Jr.
*Assistant Examiner* — Rodney Bonnette
(74) *Attorney, Agent, or Firm* — Buchanan Ingersoll & Rooney PC

(57) ABSTRACT

A pressure lever journaling a pressure roller is rockably connected to a fixation frame journaling a fixing roller. A pivotal position of the pressure lever is adjusted by a motor through driving gears, sector gears, press-contact adjusting levers, and press contact springs, so that a mode of a fixing press contact force is set to a heavy press contact mode or a light press contact mode. By a control section, at start-up immediately after power-on and on basis of a temperature and a humidity detected by a temperature and humidity sensor, the heavy press contact mode is established for rectifying poor curl conditions of paper sheets on condition that the present temperature and humidity environment is a high-temperature high-humidity environment or the light press contact mode is established for rectifying poor fixation performance on condition that the present temperature and humidity environment is a low-temperature low-humidity environment.

12 Claims, 10 Drawing Sheets

(56) References Cited

U.S. PATENT DOCUMENTS

| | | | | |
|---|---|---|---|---|
| 7,072,600 | B2 | 7/2006 | Osaki | |
| 2004/0239749 | A1 | 12/2004 | Kagawa et al. | |
| 2006/0083528 | A1 | 4/2006 | Mori et al. | |
| 2008/0181662 | A1 | 7/2008 | Lee et al. | |
| 2009/0067869 | A1 * | 3/2009 | Toyonori et al. ..... | 399/69 |

FOREIGN PATENT DOCUMENTS

| | | | |
|---|---|---|---|
| CN | 101236394 | A | 8/2008 |
| JP | 61-294475 | A | 12/1986 |
| JP | 07-319320 | | 12/1995 |
| JP | 10-301434 | A | 11/1998 |
| JP | 2002-244484 | A | 8/2002 |
| JP | 2003-270999 | A | 9/2003 |
| JP | 2003-295675 | | 10/2003 |
| JP | 2005-201947 | | 7/2005 |

OTHER PUBLICATIONS

European Search Report issued in corresponding European Patent Application No. 09814425.6, dated Dec. 14, 2011.

International Search Report (PCT/ISA/210) issued on Dec. 8, 2009, by Japanese Patent Office as the International Searching Authority for International Application No. PCT/JP2009/064486.

Office Action dated Sep. 15, 2009, issued in corresponding Japanese Patent Application No. 2008-236531, together with its English translation.

Notification of Transmittal of Translation of the International Preliminary Report on Patentability (Forms PCT/IB/338 and PCT/IB/373) and the Written Opinion of the Searching Authority ( Form PCT/ISA/237) issued on Apr. 28, 2011, in the corresponding International Application No. PCT/JP2009/064486.

Chinese Notification of First Office Action dated Sep. 23, 2013 issued in the corresponding Chinese Patent Application No. 200980136372.4 and English language translation (13 pages).

* cited by examiner

FIXING DEVICE AND IMAGE FORMING APPARATUS INCLUDING THE SAME

TECHNICAL FIELD

The present invention relates to a fixing device for fixing unfixed toner images formed on a transfer paper sheet and to an image forming apparatus including the fixing device.

BACKGROUND ART

A device as shown in FIG. 10 has already been well-known as a conventional fixing device for fixing toner images having undergone electrostatic transfer onto a transfer paper sheet in a copying machine, a printer or the like. The fixing device shown in FIG. 10 is a so-called two-roller type fixing device, which is configured so that a paper sheet 1 with toner 5 having undergone electrostatic transfer onto the sheet is pressed by two rollers, i.e., a fixing roller 2 that is on a side of the paper sheet 1 having toner images electrostatically transferred (that will be referred to as toner fixation surface side, hereinbelow) and that includes a heat source 4 and a pressure roller 3 that is placed on a side opposite to the toner fixation surface side with respect to the paper sheet 1 (that will be referred to as opposite surface side, hereinbelow) and in parallel with the fixing roller 2. Then, the toner 5 is fixed on the paper sheet 1 by heat and pressure.

In the fixing roller 2, a nip part is required to be formed widely in order to ensure fixity. For that purpose, the fixing roller 2 is composed of a cylindrical metal core 6 formed of metal and having a surface covered cylindrically with thick rubber material 7. The heat source 4 is placed along a center axis of the metal core 6. Similarly, the pressure roller 3 is composed of a cylindrical metal core 8 formed of metal and having a surface covered cylindrically with thick rubber material 9, in order to ensure pressurizing and nipping abilities.

In the above described instance that the fixing roller 2 being thick and having a large heat capacity is used, it takes about six to seven minutes as a period of time (which will be referred to as "warm-up time (WUT)" hereinbelow) since a power to the heat source 4 is turned on until a surface of the rubber material 7 has a specified temperature that makes copying possible, and there is caused a defect in that long waiting time is required when the power is turned on.

In order to eliminate the defect of the long warm-up time and reduce the warm-up time, so-called three-roller type fixing devices have been developed. FIG. 11 shows a three-roller type fixing device disclosed in JP 2002-244484 A (Patent Literature 1).

As shown in FIG. 11, the fixing device 101 disclosed in Patent Literature 1 has a fixing roller 102, a heating roller 103, a fixing belt 104 stretched between the fixing roller 102 and the heating roller 103, and a pressure roller 105 that is placed so as to face the fixing roller 102 and that is in press contact with the fixing roller 102 with the fixing belt 104 between.

The heating roller 103 is cylindrically formed of thin metal material and has a halogen heater 106 as a heat source in rotation center part thereof. The fixing roller 102 is placed on the toner fixation surface side in parallel with the heating roller 103 and has a metal core 102*a* that is cylindrically formed of metal and a silicone rubber layer 102*b* that is formed on an outer circumferential surface of the metal core 102*a*. The pressure roller 105 is placed on the opposite surface side so as to face the fixing roller 102 and has a metal core 105*a* that is cylindrically formed of metal and a silicone rubber layer 105*b* that is formed on an outer circumferential surface of the metal core 105*a*, like the fixing roller 102. The pressure roller 105 has a halogen heater 107 as a heat source in rotation center part thereof. The fixing belt 104 is driven by the heating roller 103 and the fixing roller 102 and, also when rotated, is heated by the heating roller 103 up to generally the same level as the heating roller 103 is.

In the fixing device 101 disclosed in Patent Literature 1, the heating roller 103 including the halogen heater 106 has a small heat capacity because the device is cylindrically formed of thin metal material, and the fixing belt 104 placed on the heating roller 103 also has a small heat capacity because the belt has a small volume. Therefore, a temperature of the fixing belt 104 can rapidly be increased and, even in a condition of the belt being rotated, the temperature of the fixing belt 104 is rapidly increased once it is brought into contact with the heating roller 103. Thus, the fixing belt 104 having an increased temperature is rotated and reaches the nip part on the pressure roller 105, so that fixation is allowed.

That is, the three-roller type fixing device has the warm-up time on the order of 30 to 45 seconds and has a benefit in that the waiting time on power-on is reduced.

The conventional fixing devices described above, however, have problems as follows.

Namely, a fact in common with the two-roller type fixing device and the three-roller type fixing device is that the pressure roller 3 and the pressure roller 105 used in both the fixing devices are composed of the metal core 8 and the metal core 105*a* cylindrically formed of metal and having surfaces covered with the rubber material 9 and the silicone rubber layer 105*b*, respectively, that have medium or large thicknesses and therefore have large heat capacities, for ensuring certain nip widths. Accordingly, increases in temperatures of the pressure roller 3 and the pressure roller 105 upon power-on are mild, as in the fixing roller 2 and the fixing roller 102. A rise-up of surface temperature of the pressure roller 3 is further retarded in the fixing device that lacks a heater as a heat source inside thereof, as in the pressure roller 3 in the fixing device shown in FIG. 10.

And now, in a copying machine having the fixing device installed therein, fixation performance immediately after power-on (e.g., at start of work in the morning or the like) is chiefly dominated by the surface temperature of the fixing roller (surface temperature of the fixing belt in the three-roller type fixing device), and thus, the warm-up time at start of work in the morning and the like is determined by time that elapses until the surface temperature of the fixing roller (the surface temperature of the fixing belt) reaches a specified temperature (typically on the order of 180 to 200° C.).

That is because the temperature of the fixing roller that resides on the side where toner is fixed on paper sheets has greater influence on improvement in fixation performance than the temperature of the pressure roller that is brought into press contact with the paper sheets from back side of the paper sheets opposite to the toner fixation side. In order to achieve satisfactory fixation performance at start of work in the morning, accordingly, the temperature of the fixing roller is required to be dominantly increased.

In the fixation device, typically, 80% to 100% (800 to 1000 W) of total wattage (on the order of 1000 W) is used for heating of the heater in the fixing roller and remaining 0% to 20% (0 to 200 W) thereof is used for heating of the heater in the pressure roller. In the fixing device at start of work in the morning, as shown in FIG. 12, therefore, the temperature of the fixing roller rapidly increases, while the temperature of the pressure roller calmly increases. In this regard, FIG. 12 is an example of the three-roller type fixing device in which all of total wattage for fixation is used for heating of the heater in the fixing roller and in which no heater is integrated in the pressure roller.

When the power to the fixing device is turned on at a room temperature on the order of 20° C., in the example of FIG. 12, the temperature of the fixing roller is raised to 200° C. in about 30 seconds. On the other hand, the temperature of the pressure roller is only raised to about 50° C. in about 30 seconds because no heater is integrated in the pressure roller. The heater in the fixing roller is turned off the moment the temperature of the fixing roller reaches the controlled temperature of 200° C., and temperature control operations are thereafter repeated in which the heater is turned on at temperatures lower than 200° C. (controlled temperature) and is turned off at temperatures not lower than 200° C. Though the pressure roller is increased in temperature by being heated by the fixing roller during the temperature control operations, it takes about 120 seconds for the pressure roller to be increased to the temperature on the order of 120° C., which is a saturation temperature of the pressure roller.

There is also caused a problem in that curl condition of paper sheets is deteriorated by a temperature difference between the temperatures of the fixing roller and the pressure roller at start-up of the fixing device as shown in FIG. 12 (that is, the difference of 150° C. (200° C.-50° C.) between the temperature of the fixing roller of 200° C. and the temperature of the pressure roller of 50° C.).

FIG. 13 show a mechanism of curl of a paper sheet. When a paper sheet 111 having unfixed toner (not shown) deposited thereon is conveyed to the fixing device, the unfixed toner is fixed on the paper sheet by heat and pressure in a nip part 114 between a fixing roller 112 and a pressure roller 113. At a moment as the above start-up, on condition that a surface temperature of the fixing roller 112 is higher than a surface temperature of the pressure roller 113 on this occasion, as shown in a upper part of FIG. 13, majority of moisture 115 residing in the paper sheet 111 is vaporized from a side of the fixing roller 112 in the nip part 114 and the moisture is not so much vaporized from a side of the pressure roller 113 having the lower temperature. As a result, the moisture on the side of the fixing roller 112 in the paper sheet 111 decreases, while the moisture on the side of the pressure roller 113 does not decrease so much, so that a nonequilibrium state is established. Subsequently, the moisture on the side of the pressure roller 113, as well as moisture residing in center part with respect to a longitudinal section of the paper sheet 111, moves to the side of the fixing roller 112 all at once.

As shown in a lower part of FIG. 13, consequently, the paper sheet 111 reaches a state in which the side of the fixing roller 112 is rich in moisture and in which the side of the pressure roller 113 is poor. Thus, the concentrated moisture expands the side of the fixing roller 112 in the paper sheet 111, while the escaping of moisture shrinks the side of the pressure roller 113. The expansion on one side and the shrinkage on the other side account for the mechanism of the curl of the paper sheet 111. In FIG. 13, the paper sheet 111 exhibits a back curl such that the sheet is bent toward the pressure roller.

The curl of the paper sheet occurs through such a mechanism. Therefore, the greater the temperature difference between the temperatures of the fixing roller 112 and the pressure roller 113 is, the worse the curl of the paper sheet 111 becomes. Accordingly, degree of the curl is great and disadvantageous in a high-temperature high-humidity environment (HH environment) in which there is much moisture in the paper sheet 111, while the degree is little and advantageous in a low-temperature low-humidity environment (LL environment). On the other hand, the fixation performance, which is a capability to melt and fix toner by heat and pressure, is advantageous in the high-temperature high-humidity environment (HH environment), and is disadvantageous in the low-temperature low-humidity environment (LL environment). Therefore, advantages/disadvantages in the fixation performance and the curl condition are in trade-off relation with respect to the environmental conditions.

The temperature difference between the surface temperatures of the fixing roller and the pressure roller can be controlled by a fixing press contact force that is a nip load between the fixing roller the pressure roller. In recent years, there have been appeared fixing devices that have two modes, i.e., a heavy press contact mode with a strong press contact force and a light press contact mode with a weak press contact force, as modes of the fixing press contact force. Among such devices having heavy press contact mode and light press contact mode is an electrostatic recording device disclosed in JP 61-294475 A (Patent Literature 2).

In the electrostatic recording device disclosed in Patent Literature 2, as shown in FIG. 14, a fixing device 121 has a fixing roller 123 including a heater 122 therein and a pressure roller 124 in press contact with the fixing roller 123. The fixing roller 123 is journaled by a main body (not shown) of the device and opposite ends of the pressure roller 124 are supported by levers 125. One end of each lever 125 is rockably supported by a pin fixed on the device main body and the other end thereof is biased by one end of a compression spring 126 in a direction in which the fixing roller 123 is pressed. The other end of the compression spring 126 is supported by a spring receiver 129 supported by one end of a lever 128 that rocks about a fulcrum 127 fixed on bottom part of the device main body.

When an envelope mode is selected as a mode of transfer material and a leading edge of an envelope is detected by a sensor S, a cam 133 is rotated through a stepping motor 130, a worm 131 and a worm wheel 132 so as to raise a position of an engaging point between the cam 133 and the other end of the lever 128. In this manner, the fixing press contact force between the pressure roller 124 and the fixing roller 123 is decreased from that for regular paper.

In an instance of paper such as an envelope being prone to have abnormality such as paper wrinkles or the like, occurrence of such paper wrinkles can be prevented by setting to the light press contact mode as described above. Then, switching between the heavy press contact mode and the light press contact mode changes heat transference between the fixing roller and the pressure roller, so that the temperature difference between the surface temperatures of the fixing roller and the pressure roller can be controlled.

FIGS. 15A and 15B show a mechanism of the temperature difference control according to the modes of the fixing press contact force. In the heavy press contact mode shown in FIG. 15A, the fixing roller 123 and the pressure roller 124 are brought into strong press contact with each other. In the light press contact mode shown in FIG. 15B, by contrast, the fixing roller 123 and the pressure roller 124 are brought into weak press contact with each other. In the fixing roller 123 and the pressure roller 124, elastic body of rubber is used as surface material in order to ensure formation of the nip part. Thus, the nip width is widened in the heavy press contact mode and is narrowed in the light press contact mode. Accordingly, heat transfer between the fixing roller 123 and the pressure roller 124 is activated in the heavy press contact mode with the large nip width (contact area) and is inactivated in the light press contact mode. In the heavy press contact mode, consequently, heat in the fixing roller 123 having a high temperature is more actively transferred to the pressure roller 124 having a low temperature.

As one example, FIG. 16 shows manners of increase in the temperatures of the fixing roller and the pressure roller at start of work in the morning in the three-roller type fixing device. When the power to the fixing device and a heater for the fixing roller are turned on at a room temperature on the order of 20° C., in the example of FIG. 16, the temperature of the fixing roller having a large heater wattage rapidly increases and the temperature of the pressure roller having a small (or no) heater wattage calmly increases in both the heavy press contact mode and the light press contact mode. In the heavy press contact mode with active heat transfer, rising in the temperature of the pressure roller is accelerated because heat from the fixing roller whose temperature is rapidly increasing is actively transferred to the pressure roller. As a result, rising in the temperature of the fixing roller from which heat escapes to the pressure roller is decelerated. In the light press contact mode with inactive heat transfer, by contrast, the rising in the temperature of the pressure roller is decelerated in comparison with the heavy press contact mode. As a result, the rising in the temperature of the fixing roller whose heat is hard to escape to the pressure roller is more accelerated than in the heavy press contact mode.

At a point in time when 30 seconds have elapsed since the heater for the fixing roller was turned on, in the example shown in FIG. 16, the temperatures of the fixing roller/the pressure roller are 170° C./80° C. in the heavy press contact mode and 200° C./50° C. in the light press contact mode.

The conventional electrostatic recording device disclosed in Patent Literature 2, however, has problems as follows.

Provided that the light press contact mode is set as the mode of the fixing press contact force, and that the surface temperature of the fixing roller which dominates the fixation performance is attempted to be higher in order to improve the fixation performance at start-up of the electrostatic recording device, the surface temperature of the pressure roller becomes lower as is understood from FIG. 16. This increases the difference between the surface temperatures of the fixing roller and the pressure roller (the example shown in FIG. 16 results in the difference of 150° C. (=200° C.-50° C.)), and causes the problem in that curl condition of paper sheets is deteriorated as described above.

On the contrary, provided that the heavy press contact mode in which the surface temperature difference between the fixing roller and the pressure roller is small is set in order to improve the curl condition of paper sheets, the rising in the temperature of the fixing roller is decelerated, although the temperature difference between the fixing roller and the pressure roller becomes small. This causes a problem of deterioration in fixation performance at start in the morning or extension of warm-up time.

CITATION LIST

Patent Literature

Patent Literature 1: JP 2002-244484 A
Patent Literature 2: JP 61-294475 A

SUMMARY OF INVENTION

Technical Problem

An object of the invention is to provide a fixing device where particularly satisfactory fixation performance and satisfactory curl condition can go together immediately after power-on, and to provide an image forming apparatus having the same.

Solution to Problem

To achieve the above object, a fixing device according to the present invention comprises:

a heat source, a fixing roller that is heated by heat provided from the heat source and that is rotatable, a pressure roller that is rotatably brought into press contact with a surface of the fixing roller so as to form a nip part and that causes the nip part to fix unfixed toner images, which is formed on a surface of recording medium, onto the recording medium, and a pressure adjusting unit that determines whether a predetermined condition holds or not, and when the condition holds, the pressure adjusting unit adjusts a nip pressure of the nip part between the fixing roller and the pressure roller.

With the change in the nip pressure of the nip part between the fixing roller and the pressure roller, heat transfer from the fixing roller to the pressure roller is changed, so that the surface temperature of the fixing roller and the difference between the surface temperatures of the fixing roller and the pressure roller can be changed.

According to the above configuration, the nip pressure is adjusted by the pressure adjusting unit, when the predetermined condition holds. Thus, the surface temperature of the fixing roller and the difference between the temperatures of the fixing roller and the pressure roller can be adjusted according to the condition. Therefore, satisfactory fixation performance and satisfactory curl conditions of paper sheets can go together. This is effective immediately after power-on, in particular.

Moreover, a fixing device according to the present invention comprises:

a heat source, a fixing roller that is heated by heat provided from the heat source and that is rotatable, a pressure roller that is rotatably brought into press contact with a surface of the fixing roller so as to form a nip part and that causes the nip part to fix unfixed toner images, which is formed on a surface of recording medium, onto the recording medium, at least one of first temperature detecting section for detecting a surface temperature of the fixing roller and second temperature detecting section for detecting a surface temperature of the pressure roller, and a pressure adjusting unit that adjusts a nip pressure of the nip part between the fixing roller and the pressure roller on basis of at least one of the temperature detected by the first temperature detecting section and the temperature detected by the second temperature detecting section.

When the heat source is turned on, the fixing roller and the pressure roller exhibit surface temperatures that are generally equivalent to an environment temperature. Accordingly, environmental temperature and humidity can be detected with detection of the surface temperatures of at least one of the fixing roller and the pressure roller when the heat source is turned on.

With the change in the nip pressure of the nip part between the fixing roller and the pressure roller, heat transfer from the fixing roller to the pressure roller is changed, so that the surface temperature of the fixing roller and the difference between the surface temperatures of the fixing roller and the pressure roller can be changed.

According to the above configuration, the pressure adjusting unit adjusts the nip pressure of the nip part between the fixing roller and the pressure roller on basis of at least one of the temperature of the fixing roller that is detected by the first temperature detecting section and the temperature of the pressure roller that is detected by the second temperature detecting section. Thus, the surface temperature of the fixing roller and the difference between the temperatures of the fixing roller and the pressure roller can be adjusted according to the environmental temperature and humidity. Therefore, satisfactory fixation performance and satisfactory curl conditions of paper sheets can go together. This is effective immediately after power-on, in particular.

Moreover, an image forming apparatus according to the present invention comprises:

an image forming unit for forming unfixed toner images of electrified toner on a surface of recording medium, and the fixing device as claimed in claim 1.

According to the above configuration, the fixing device is provided, where satisfactory fixation performance and satisfactory curl conditions of paper sheets can go together immediately after power-on, by the adjustment of the nip pressure between the fixing roller and the pressure roller, and then by the resultant adjustment of the surface temperature of the fixing roller and the difference between the temperatures of the fixing roller and the pressure roller, when the predetermined condition holds. Therefore, satisfactory fixation can be achieved without prolongation of warm-up time immediately after power-on at start-up in the morning or the like.

Moreover, an image forming apparatus according to the present invention comprises:

an image forming unit for forming unfixed toner images of electrified toner on a surface of recording medium, and the fixing device as claimed in claim 8.

According to the above configuration, the fixing device is provided, where satisfactory fixation performance and satisfactory curl conditions of paper sheets can go together immediately after power-on, by the adjustment of the nip pressure between the fixing roller and the pressure roller on basis of at least one of the surface temperature of the fixing roller and surface temperature of the pressure roller, and then by the resultant adjustment of the surface temperature of the fixing roller and the difference between the temperatures of the fixing roller and the pressure roller. Therefore, satisfactory fixation can be achieved without prolongation of warm-up time immediately after power-on at start-up in the morning or the like.

Advantageous Effects of Invention

As is clear by the above, according to a fixing device of the present invention, the nip pressure of the nip part between the fixing roller and the pressure roller is adjusted by the pressure adjusting unit when the predetermined condition holds. Thus, the surface temperature of the fixing roller and the difference between the temperatures of the fixing roller and the pressure roller can be adjusted according to the condition. Therefore, satisfactory fixation performance and satisfactory curl conditions of paper sheets can go together. This is effective immediately after power-on, in particular.

Moreover, in a fixing device of the present invention, the pressure adjusting unit adjusts the nip pressure of the nip part between the fixing roller and the pressure roller on basis of at least one of the temperature of the fixing roller that is detected by the first temperature detecting section and the temperature of the pressure roller that is detected by the second temperature detecting section. Thus, the surface temperature of the fixing roller and the difference between the temperatures of the fixing roller and the pressure roller can be adjusted according to the environmental temperature and humidity. Therefore, satisfactory fixation performance and satisfactory curl conditions of paper sheets can go together. This is effective immediately after power-on, in particular.

Moreover, an image forming apparatus of the present invention comprises the fixing device where satisfactory fixation performance and satisfactory curl conditions of paper sheets can go together immediately after power-on, by the adjustment of the nip pressure between the fixing roller and the pressure roller, and then by the resultant adjustment of the surface temperature of the fixing roller and the difference between the temperatures of the fixing roller and the pressure roller, when the predetermined condition holds. Therefore, satisfactory fixation can be achieved without prolongation of warm-up time immediately after power-on at start-up in the morning or the like.

Moreover, an image forming apparatus of the present invention comprises the fixing device where satisfactory fixation performance and satisfactory curl conditions of paper sheets can go together immediately after power-on, by the adjustment of the nip pressure between the fixing roller and the pressure roller on basis of at least one of the surface temperature of the fixing roller and surface temperature of the pressure roller, and then by the resultant adjustment of the surface temperature of the fixing roller and the difference between the temperatures of the fixing roller and the pressure roller. Therefore, satisfactory fixation can be achieved without prolongation of warm-up time immediately after power-on at start-up in the morning or the like.

DESCRIPTION OF EMBODIMENTS

Figure 1:
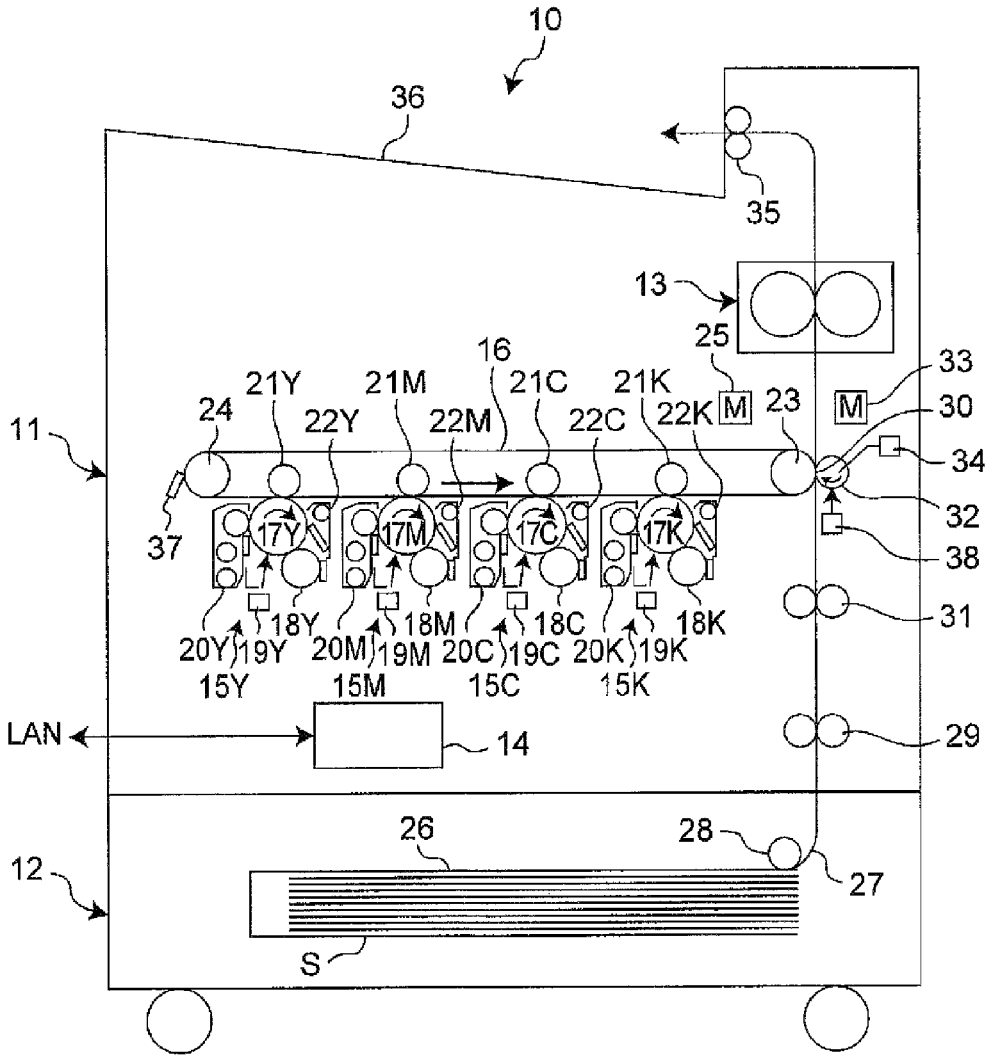
FIG. 1 is a diagram showing a general configuration of an image forming apparatus of the invention.

Hereinbelow, the invention will be described in detail with reference to embodiments shown in the drawings.

First Embodiment

FIG. 1 is a diagram showing a general configuration of an image forming apparatus of the embodiment. Hereinbelow, the general configuration of the image forming apparatus of the embodiment will be described with reference to FIG. 1 by way of an example of a tandem-type color digital printer (which will be referred to simply as "printer" hereinbelow).

The printer 10, which forms images in a well-known electrophotographic method, includes an image processing section 11, a feeding section 12, a fixing section 13, and a control section 14 as shown in FIG. 1. The printer 10 is connected to a network, e.g., composed of LAN (Local Area Network), and forms color images of yellow, magenta, cyan, and black, upon reception of an instruction for execution of a print job from an external terminal unit (not shown), in accordance with the instruction. Hereinbelow, reproduced colors of yellow, magenta, cyan, and black will be represented by characters Y, M, C, and K, respectively, and the characters are added as subscripts to reference numbers of members associated with the reproduced colors.

The image processing section 11 as an image forming section includes image forming units 15Y, 15M, 15C, and 15K corresponding to the reproduced colors Y, M, C, and K, respectively, an intermediate transfer belt 16, and the like.

The image forming units 15Y through 15K include photoconductor drums 17Y through 17K, charging units 18Y through 18K, exposure units 19Y through 19K, developing units 20Y through 20K, primary transfer rollers 21Y through 21K, cleaners 22Y through 22K for cleaning the photoconductor drums 17Y through 17K, and the like, which are provided around the photoconductor drums 17Y through 17K, and form toner images of the reproduced colors Y, M, C, and K on the photoconductor drums 17Y through 17K. The exposure unit 19Y has, in inside thereof, a laser diode, a polygon mirror for deflecting a laser beam emitted from the laser diode and scanning a surface of the photoconductor drum 17Y for exposure with the beam in a main scanning direction, a scanning lens and the like. Other exposure units 19M through 19K have similar configurations.

The intermediate transfer belt 16 forming the image processing section 11 is an endless belt, which is stretched between a driving roller 23 and a driven roller 24, and is rotated by a belt driving motor 25 in a direction of an arrow.

The feeding section 12 includes a sheet feeding cassette 26 for containing paper sheets S as sheets for recording, a feed roller 28 for feeding the paper sheets S one by one into a conveying path 27, a conveying roller pair 29 for conveying the fed paper sheet S, a timing roller pair 31 for adjusting timings of feeding the paper sheet S to a secondary transfer position 30, and a secondary transfer roller 32 that is in press contact with the driving roller 23 with the intermediate transfer belt 16 therebetween in the secondary transfer position 30.

The secondary transfer roller 32 is a conductive elastic roller having foaming NBR(nitrile rubber) with addition of ionic conductive material, for instance, and is driven and rotated by a secondary transfer roller driving motor 33 in a direction of an arrow. To the secondary transfer roller 32 is applied a secondary transfer voltage outputted from a secondary transfer voltage output 34. Thus, an electrostatic force for secondary transfer acts between the secondary transfer roller 32 and the driving roller 23.

The fixing section 13 has a fixing roller and a pressure roller as will be described later in detail and fixes toner images by heating and pressing a paper sheet S at a specified fixation temperature.

Hereinbelow will be described image forming operations (toner image formation, sheet feeding, transfer of toner images onto sheet, fixation of toner images, and sheet ejection) of the image forming apparatus having the above configuration.

The control section 14 converts image signals from the external terminal unit to digital signals for the reproduced colors Y, M, C, and K so as to produce drive signals for driving the laser diodes of the exposure units 19Y through 19K. The produced drive signals drive the laser diodes of the exposure units 19Y through 19K to emit laser beams L, by which exposure and scanning of the photoconductor drums 17Y through 17K are carried out.

Before the exposure and scanning are carried out by the exposure units 19Y through 19K, the photoconductor drums 17Y through 17K are uniformly charged in advance by the charging units 18Y through 18K. The exposure and scanning by the laser beams L from the exposure units 19Y through 19K form electrostatic latent images on the photoconductor drums 17Y through 17K.

The electrostatic latent images are developed with toner by the developing units 20Y through 20K. The toner images obtained in this manner on the photoconductor drums 17Y through 17K undergo primary transfer onto the intermediate transfer belt 16 by agency of electrostatic forces acting between the primary transfer rollers 21Y through 21K and the photoconductor drums 17Y through 17K. In this process, image forming operations for the respective colors are carried out with different timings so that the toner images having the respective colors are transferred and superposed onto the same position on the intermediate transfer belt 16. Thus, the toner images of the respective colors superposed onto the intermediate transfer belt 16 by the primary transfer travel to the secondary transfer position 30 with the rotation of the intermediate transfer belt 16.

In synchronization with the above-mentioned image forming operations for the respective colors on the intermediate transfer belt 16, a paper sheet S has been fed by the timing roller pair 31 from the feeding section 12 with the feeding. The paper sheet S is conveyed while being nipped between the intermediate transfer belt 16 and the secondary transfer roller 30, so that the toner images on the intermediate transfer belt 16 collectively undergo a secondary transfer onto the paper sheet S by agency of the electrostatic force acting between the secondary transfer roller 32 as the transfer roller and the driving roller 23.

Thus, the paper sheet S having passed through the secondary transfer position 30 is conveyed to the fixing section 13, where the toner images are heated and pressed so as to be fixed on the paper sheet S. After that, the paper sheet S is ejected by ejection rollers 35 and is stored in a storage tray 36.

Hereinbelow, a configuration and operations of the fixing section 13 will be described in detail.

Figure 2:
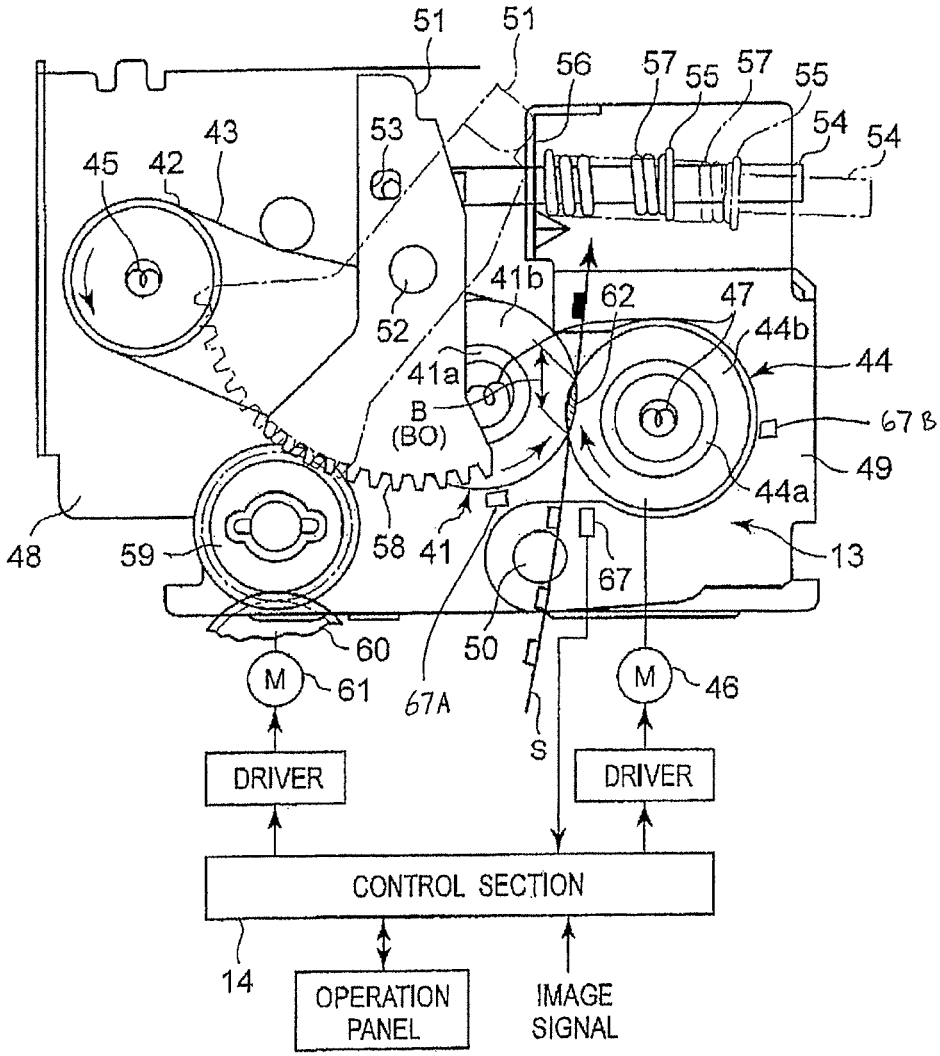
FIG. 2 is a schematic sectional view showing a configuration of a fixing section in FIG. 1.

FIG. 2 is a schematic sectional view showing the configuration of the fixing section 13. In FIG. 2, the fixing section 13 of the embodiment is a so-called three-roller type fixing device. Modes of fixing press contact force therein are switched according to temperature and humidity environments.

As shown in FIG. 2, the fixing section 13 has a fixing roller 41, a heating roller 42, a fixing belt 43 stretched between the fixing roller 41 and the heating roller 42, and a pressure roller 44 that is placed so as to face the fixing roller 41 and that is brought into press contact with the fixing roller 41 by press contact springs 57, with the fixing belt 43 therebetween.

The heating roller 42 is cylindrically formed of thin metal material and has a halogen heater 45 as a heat source in rotation center part thereof. The heat source is not limited to halogen heater but may be composed of nichrome wire heater, ceramic heater, xenon heater or the like or may employ IH (induction heating) method or surf heating method.

The fixing roller 41 is placed on a side of the paper sheet S having toner images electrostatically transferred (that will be referred to as "toner fixation surface side" hereinbelow), in parallel with the heating roller 42, and has a metal core 41*a* that is cylindrically formed of metal such as iron and aluminum and a rubber layer 41*b* of silicon or the like that is formed on an outer circumferential surface of the metal core 41*a*. The rubber layer 41*b* is not limited to above-mentioned silicon but urethane, NBR, EPDM (ethylene propylene diene rubber) or the like may be used therefor.

The pressure roller 44 is placed on a side opposite to the toner fixation surface side with respect to the paper sheet S (that will be referred to as "opposite surface side", hereinbelow) so as to face the fixing roller 41 and, as in the fixing roller 41, has a metal core 44*a* that is cylindrically formed of metal such as iron and aluminum and a rubber layer 44*b* of silicon or the like that is formed on an outer circumferential surface of the metal core 44*a*. The rubber layer 44*b* is not limited to above-mentioned silicon but urethane, NBR, above-mentioned EPDM or the like may be used therefor. As described above, the pressure roller 44 is brought into press contact with the fixing roller 41 by the press contact springs 57 with a pressure on the order of 500 N(Newtons). The pressure roller 44 is rotated by a pressure roller driving motor 46 in a directions of an arrow. Concomitantly with it, the fixing roller 41, the fixing belt 43 and the heating roller are rotated in directions of respective arrows. The fixing roller 41 includes a halogen heater 47 as a heat source in rotation center part thereof. The heat source is not limited to halogen heater but may be composed of nichrome wire heater, ceramic heater, xenon heater or the like or may employ IH heating method or surf heating method. It does not matter if the halogen heater 47 is omitted.

The fixing belt 43 is driven by the fixing roller 41 and, also when rotated, is heated by the heating roller 42 up to generally the same level as the heating roller 42 is.

As described above, the modes of fixing press contact force in the fixing section 13 are switched according to temperature and humidity environments. Hereinbelow will be described a mechanism for altering the fixing press contact force.

A pressure lever 49 journaling the pressure roller 44 is rockably connected through a fulcrum shaft 50 to a fixation frame 48 journaling the fixing roller 41 and the heating roller 42. In the fixation frame 48, press contact adjusting levers 51 are pivotably supported by a shaft 52. Extremities of shafts 54 are engaged with holes 53 provided on one end side of the press contact adjusting levers 51, and the press contact springs 57 are compressed and inserted between spring seats 55 provided on the shafts 54 and pressure receiving parts 56 provided in the pressure lever 49. Thus, the pressure lever 49 is biased by spring forces of the press contact springs 57 so as to be spaced apart from the fixation frame 48 all the time.

The other end of each press contact adjusting lever 51 forms a part of a circular arc having a center on the shaft 52, and a sector gear 58 is formed on the other end. A driving gear 59 meshes with the sector gear 58 and is driven through a speed reducing mechanism 60 by a motor 61.

In this manner, stepless displacement of a pivotal position of the press contact adjusting levers 51 that is caused by the motor 61 through the driving gears 59 meshing with the sector gears 58 on the other ends of the levers results in stepless adjustment of the spring forces with which the press contact springs 57 bring the pressure roller 44 into press contact with the fixing roller 41, and the change in the spring forces of the press contact springs 57 causes stepless change in a nip width B of a nip part 62. Specifically, a rotational position of the motor 61 is controlled by the control section 14 and the nip width B of the nip part 62 is thereby changed without step.

Figure 3:
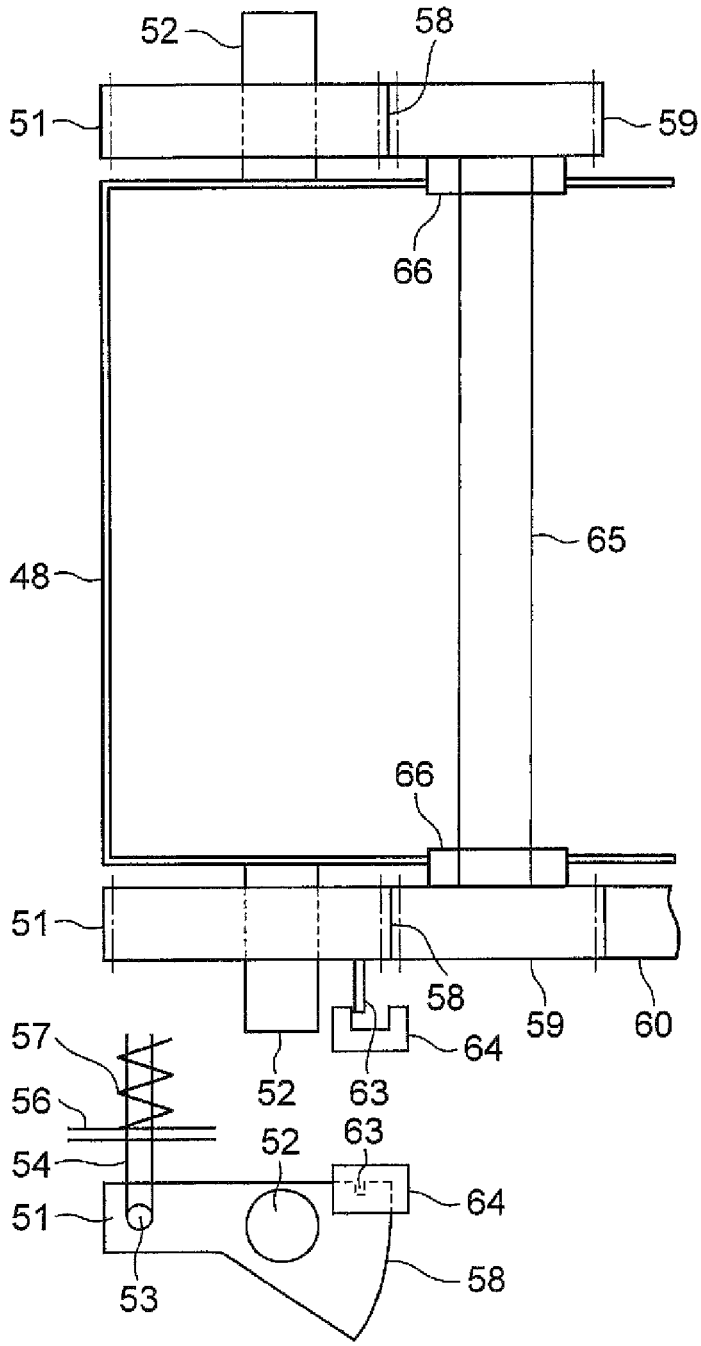
FIG. 3 is a schematic plan view of the fixing section shown in FIG. 2.

FIG. 3 is a schematic plan view of the fixing section 13 shown in FIG. 2. On a side part of a press contact adjusting lever 51, as shown in FIG. 3, a traveling member 63 is provided that horizontally protrudes and that travels together with the press contact adjusting lever 51. On a lateral side of the fixation frame 48 is provided a sensor such as a photo interrupter 64 for detecting the traveling member 63 on the press contact adjusting lever 51. It is detected and determined by a combination of the traveling member 63 and the photo interrupter 64 whether the press contact adjusting lever 51 is in a pivotal position corresponding to a reference press contact position between the fixing roller 41 and the pressure roller 44. According to a result of the determination, the control section 14 drives the motor 61 so that positions of the press contact adjusting levers 51 result in a normal reference press contact state. Subsequently, the press contact adjusting levers 51 are driven by the motor 61 relative to the reference state so that the pressure roller is moved to a pressure increasing side or a pressure decreasing side with respect to the fixing roller 41 in accordance with a temperature and humidity environment as will be described later in detail. Thus, various press contact conditions are established in the nonstep manner.

In the fixing section 13 of the embodiment, corresponding to large pressure loads of the fixing roller 41 and the heating roller 42, the press contact adjusting levers 51 supported by the shaft 52 are provided on both left and right sides of the fixation frame 48, and the pair of driving gears 59 meshing with the sector gears 58 of both the press contact adjusting levers 51 are provided through a driving shaft 65 and a pair of bearings 66 on the fixation frame 48. In this manner, the pressure roller 44 is uniformly and stably brought into press contact with the fixing roller 41 on left and right sides thereof by the pair of the left and right press contact adjusting levers 51 and the corresponding pair of the press contact springs 57 provided on left and right sides of the pressure lever 49. A driving force from the motor 61 has only to be transmitted to one of the driving gears 59 through the speed reducing mechanism such as a reduction gear 60, as shown in FIG. 2.

Figure 4:
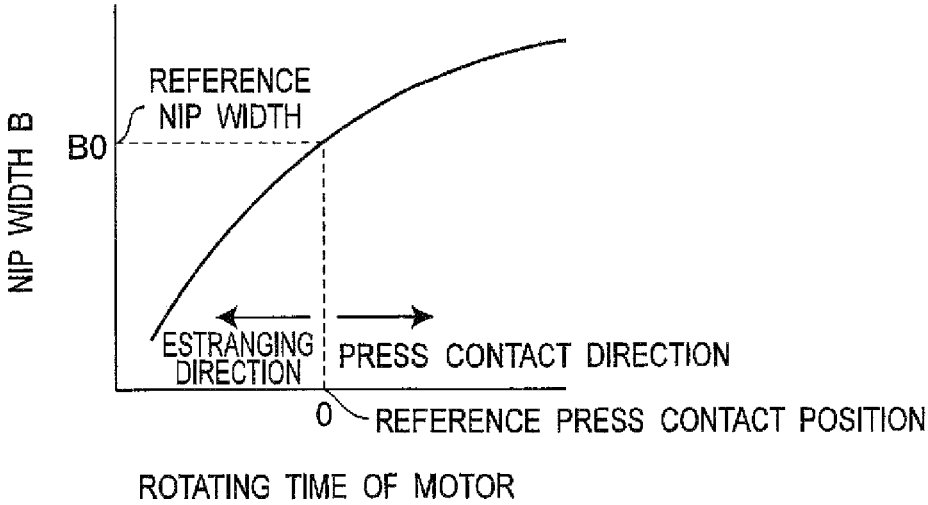
FIG. 4 is a diagram showing a relation among rotating time of a motor, traveling direction of a pressure roller, and nip width.

For adjustment of the nip width B relative to a reference nip width B0 that is a width of the nip part 62 in the reference press contact position in the above configuration, as shown in FIG. 4, a relation among rotating time of the motor 61 relative to the reference press contact position, driving directions of the press contact adjusting levers 51 with the rotation (traveling directions of the pressure roller 44), and the nip width B is found in advance and is stored in a memory or the like in the control section 14. The control section 14 determines a target nip width B in accordance with a temperature and a humidity that are detected by a temperature and humidity sensor 67 (see FIG. 2) and drives the motor 61 during and in a period of time and a direction that correspond to a difference between the target nip width B and the reference nip width B0, in accordance with the relation shown in FIG. 4.

Though it is simple to switch the driving direction of the motor 61 in this operation by selection of forward or reverse direction of rotation of the motor 61, the switching may be attained with use of a driving direction switching mechanism.

Figure 5:
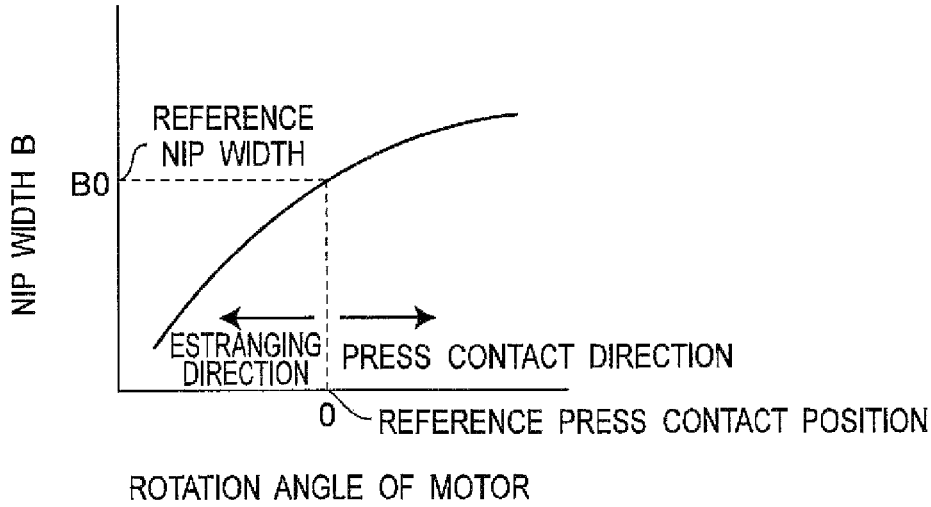
FIG. 5 is a diagram showing a relation among rotation angle of the motor, traveling direction of the pressure roller, and nip width.

For adjustment of the nip width B relative to the reference nip width B0, as shown in FIG. 5, a relation among rotation angle of the motor 61 or the press contact adjusting levers 51 driven by the motor 61, driving directions of the motor 61 or the press contact adjusting levers 51 with the rotation (traveling directions of the pressure roller 44), and the nip width B may be found in advance and may be stored in a memory or the like in the control section 14. The control section 14 may determine a target nip width B in accordance with a temperature and a humidity that are detected by the temperature and humidity sensor 67 (see FIG. 2) and may drive the motor 61 on basis of an angle and a direction of rotation that correspond to a difference between the target nip width B and the reference nip width B0, in accordance with the relation shown in FIG. 5.

This method of adjustment of the nip width B is effective on condition that the control cannot be stabilized by the driving time of the motor 61. Specifically, the method can be attained by detection of rotational position of a pulse disk or the like pivoting in synchronization with the motor 61, the driving gears 59, the press contact adjusting levers 51, and the pressure lever 49, with use of rotation detecting means (not shown).

Figure 6:
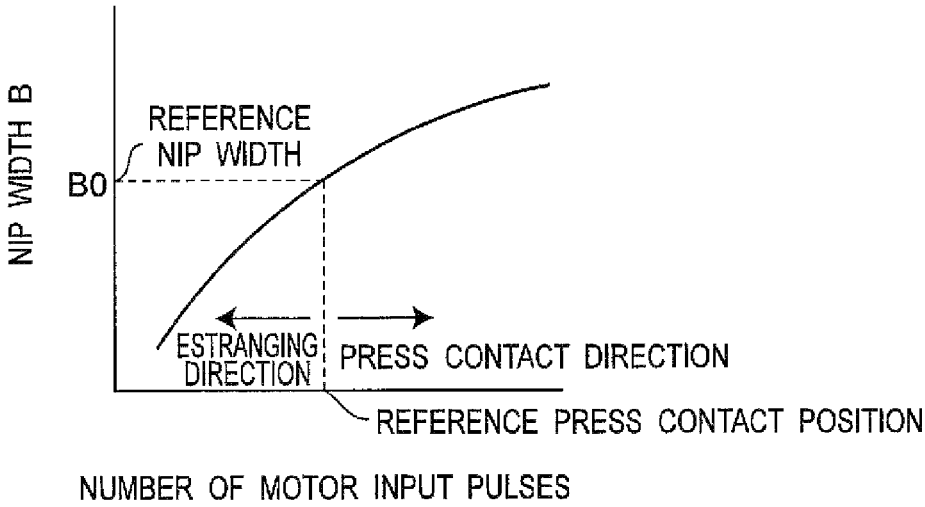
FIG. 6 is a diagram showing a relation between number of inputted pulses to the motor and nip width.

For adjustment of the nip width B relative to the reference nip width B0 on condition that the motor 61 is a stepping motor or the like which is driven and controlled by supply drive pulses from the control section 14, as shown in FIG. 6, a relation between number of drive pulses inputted into the motor 61 and the nip width B may be found in advance and may be stored in a memory or the like in the control section 14. The control section 14 may determine a target nip width B in accordance with a temperature and a humidity that are detected by the temperature and humidity sensor 67 and may drive the motor 61 on basis of the number of inputted pulses that corresponds to a difference between the target nip width B and the reference nip width B0, in accordance with the relation shown in FIG. 6.

Figure 7:
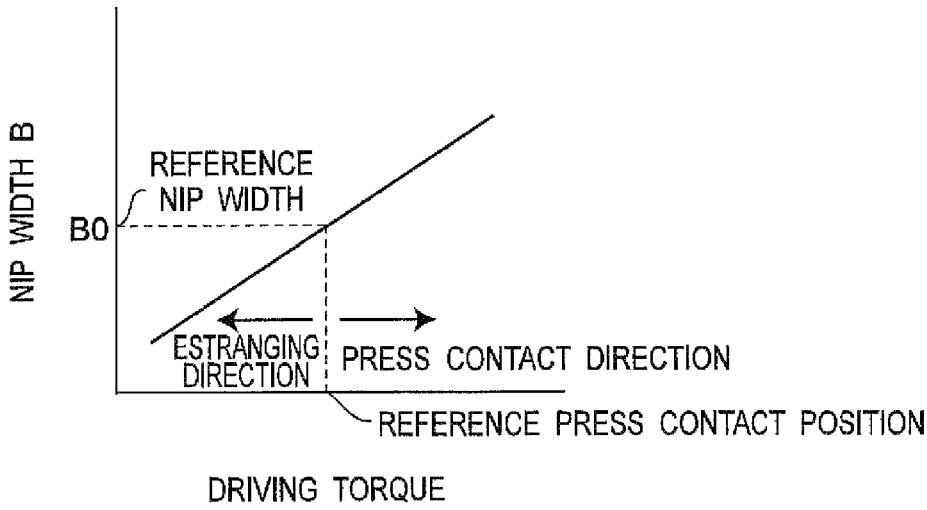
FIG. 7 is a diagram showing a relation between driving torque and nip width.

There may be provided driving torque detection means (not shown) for detecting driving torque of a member for driving the pressure roller 44. For adjustment of the nip width B relative to the reference nip width B0, as shown in FIG. 7, a relation between the driving torque detected by the driving torque detection means and the nip width B may be found in advance and may be stored in a memory or the like in the control section 14. The control section 14 may determine a target nip width B in accordance with a temperature and a humidity that are detected by the temperature and humidity sensor 67 and may drive the motor 61 on basis of the driving torque that corresponds to a difference between the target nip width B and the reference nip width B0, in accordance with the relation shown in FIG. 7.

Hereinbelow will specifically be described a method of changing the nip width of the nip part 62 in accordance with a temperature and a humidity that are detected by the temperature and humidity sensor 67. In general, it is preferable that an image forming apparatus can be used under wide range of temperature-humidity environments from high-temperature high-humidity environment (HH environment) to low-temperature low-humidity environment (LL environment). In general, herein, the HH environment is on the order of 30° C./80% and the LL environment is on the order of 10° C./10%.

In the HH environment, fixation performance is satisfactory because of the high temperature while curl conditions of paper sheets are disadvantageous because of the high humidity. Accordingly, a surface temperature of the fixing roller 41, dominating the fixation performance, at start-up in the morning is not required to be so high in comparison with the LL environment. Instead, the curl conditions of paper sheets are unsatisfactory, and therefore a difference between surface temperatures of the fixing roller 41 and the pressure roller 44 is preferably small.

In the LL environment, in contrast to that, fixation performance is unsatisfactory because of the low temperature while curl conditions of paper sheets are satisfactory because of the low humidity. Accordingly, a surface temperature of the fixing roller 41 dominating the fixation performance is required to be high in comparison with the HH environment. Instead, the curl conditions of paper sheets are satisfactory, and therefore the difference between the surface temperatures of the fixing roller 41 and the pressure roller 44 does not have to be so small.

In the embodiment, therefore, the control section determines whether present temperature and humidity environment is the HH environment or the LL environment on basis of a temperature and a humidity that are detected by the temperature and humidity sensor 67. In this process, preferably, boundary temperatures between the HH environment and the LL environment are set at 25° C. that is 5° C. lower than 30° C. in the HH environment and 15° C. that is 5° C. higher than 10° C. in the LL environment, for instance, and boundary humidities are set at 70% that is 10% lower than 80% in the HH environment and 20% that is 10% higher than 10% in the LL environment, for instance. The boundary temperatures and the boundary humidities are preferably set appropriately as circumstances demand.

On condition that the control section 14 determines that the present temperature and humidity environment is in the HH environment, the control section 14 sets the mode of the fixing press contact force to the heavy press contact mode having a small difference between the surface temperatures of the fixing roller 41 and the pressure roller 44, in order to improve the poor curl conditions of paper sheets at start-up in the morning. On condition that the control section 14 determines that the present temperature and humidity environment is in the LL environment, the control section 14 sets the mode of the fixing press contact force to the light press contact mode that leads to increase in the surface temperatures of the fixing roller 41, in order to improve the poor fixation performance at start-up in the morning or the like.

In this case, a target nip width B1 of the nip part 62 in the heavy press contact mode and a target nip width B2 in the light press contact mode are set in advance and are registered in a memory in the control section 14. For the establishment of the heavy press contact mode, the control section 14 finds rotating time of the motor 61, a rotation angle of the motor 61, a number of inputted pulses to the motor 61, the driving torque for the pressure roller 44, or the like that are determined in accordance with a difference between the target nip width B1 and the reference nip width B0. The motor 61 is driven on basis of the determined values, and the target nip width B1 of the nip part 62 is set at a specified nip width B according to the established mode of the fixing press contact force. The establishment of the light press contact mode is similarly attained.

Figure 8:
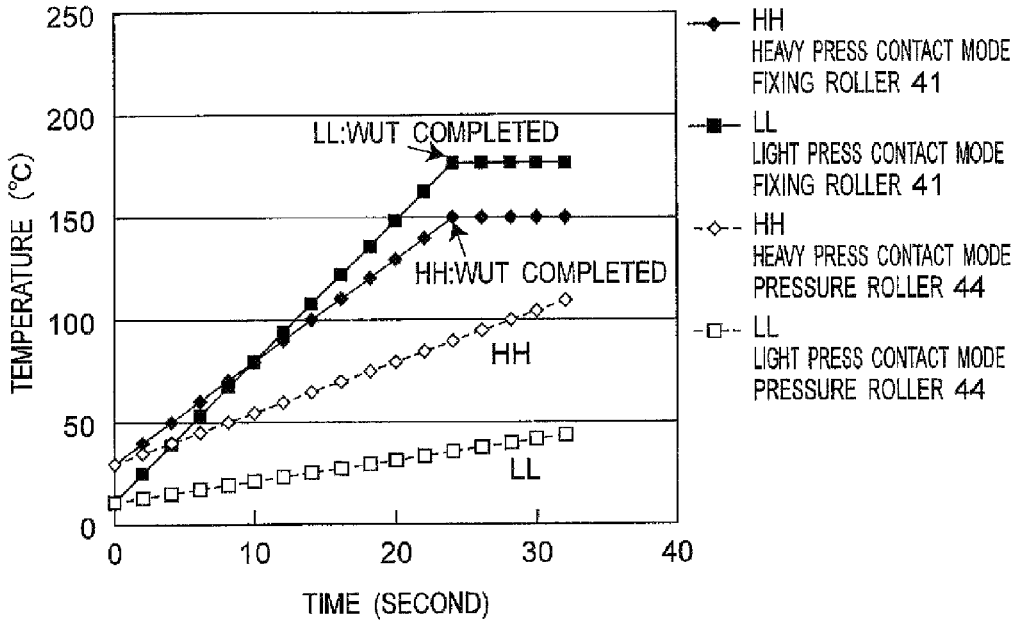
FIG. 8 is a diagram showing change in surface temperatures of a fixing roller and the pressure roller in a high-temperature high-humidity environment (HH environment) and a low-temperature low-humidity environment (LL environment)

On condition that the heaters 45, 47 are turned on, e.g., at a room temperature on the order of 30° C. in the HH environment, e.g., as shown in FIG. 8, consequently, a quantity of heat transfer from the fixing roller 41 to the pressure roller 44 is increased because the mode of the fixing press contact force has been set to the heavy press contact mode. Thus, the surface temperature of the fixing roller 41 does not so rapidly rise as in the LL environment while the surface temperature of the pressure roller 44 rapidly rises. About 23 seconds after the heaters 45, 47 are turned on, therefore, the temperature of the fixing roller 41 reaches about 150° C. and the temperature of the pressure roller 44 reaches about 90° C. In this case, the difference between the temperatures of the fixing roller 41 and the pressure roller 44 becomes 60° C., and the small temperature difference of such a degree results in achievement of satisfactory curl conditions of paper sheets. In the HH environment, which originally leads to satisfactory fixation performance, sufficient fixation performance can be ensured even though the surface temperature of the fixing roller 41 is on the order of 150° C.

On condition that the heaters 45, 47 are turned on, e.g., at a room temperature on the order of 10° C. in the LL environment, by contrast, a quantity of heat transfer from the fixing roller 41 to the pressure roller 44 is decreased because the mode of the fixing press contact force has been set to the light press contact mode. Thus, the surface temperature of the fixing roller 41 rises more rapidly than in the HH environment while the surface temperature of the pressure roller 44 slowly rises. About seconds after the heaters 45, 47 are turned on, therefore, the temperature of the fixing roller 41 reaches about 180° C. while the temperature of the pressure roller 44 reaches no more than about 35° C. In this case, the difference between the temperatures of the fixing roller 41 and the pressure roller 44 becomes no less than about 145° C. Satisfactory curl conditions of paper sheets, however, can be achieved even with the temperature difference on the order of 145° C. because the LL environment originally leads to satisfactory curl conditions of paper sheets. Though the fixation performance is poor in the LL environment, the surface temperature of the fixing roller 41 dominating the fixation performance has risen to about 180° C., and thus, sufficient fixation performance can be attained.

By above control operations carried out during the warm-up time as preparation prior to image forming operations, cancellation of the mode of the fixing press contact force, return to a normal press contact mode, and start of the operations of fixation can be attained with timing of completion of the warm-up time, in both the HH environment and the LL environment. This eliminates waiting time till attainment of satisfactory curl conditions of paper sheets after completion of the warm-up time during which the fixing roller 41 is dominantly heated, and substantially decreases the warm-up time.

In the embodiment, namely, satisfactory fixation performance and satisfactory curl conditions of paper sheets can go together even when power is turned on at start-up in the morning or the like.

In the embodiment, it is detected whether present temperature and humidity environment is the HH environment or the LL environment, on basis of a temperature and a humidity that are detected by the temperature and humidity sensor 67. The invention, however, is not limited thereto.

Upon power-on at start-up in the morning or the like, for instance, the fixing roller 41 and the pressure roller 44 exhibit surface temperatures that are generally equivalent to an environment temperature. The invention can be configured so that the fixing roller 41 or the pressure roller 44 is provided with a first thermistor 67A as the first temperature detecting section for detecting the surface temperature of the fixing roller 41 or a second thermistor 67B as the second temperature detecting section for detecting the surface temperature of the pressure roller 44 and so that the control section 14 determines whether environmental temperature and humidity on power-on are within the HH environment or within the LL environment on basis of a result of comparison between the temperature detected by the first thermistor or the temperature detected by the second thermistor and a predetermined comparison value. On condition that the temperature detected by the first thermistor or the second thermistor is not higher than the predetermined temperature, that is, in the low-temperature low-humidity environment, for instance, the mode of the fixing press contact force is set to the light press contact mode. On condition that the temperature detected by the first thermistor is not lower than the predetermined temperature, that is, in the high-temperature high-humidity environment, the mode of the fixing press contact force is set to the heavy press contact mode.

As a matter of course, there is no problem if both the fixing roller 41 and the pressure roller 44 are provided with thermistors (not shown) for detecting the surface temperatures and if environmental temperature and humidity on power-on are determined on basis of the temperatures detected by both the thermistors. The mode of the fixing press contact force may be set to the heavy press contact mode on condition that a difference between the temperatures detected by both the thermistors exceeds a first specified temperature difference, and may be set to the light press contact mode on condition that the difference is not larger than a second specified temperature difference smaller than the first specified temperature difference.

Second Embodiment

A general configuration of an image forming apparatus of the embodiment and a configuration of a fixing section 13 therein are the same as those of the first embodiment, and description thereof will be omitted.

Though the modes of the fixing press contact force are switched and established according to temperature and humidity environments in the first embodiment, the modes of the fixing press contact force are switched and established according to a type of paper sheet in the present embodiment.

On condition that a printer has not been used for a specified period of time or longer, in general, the printer is set into stand-by mode in which temperatures of the fixing roller 41 and the pressure roller 44 are controlled to be low for reduction in power consumption. During the stand-by mode, the surface temperature of the fixing roller 41 is on the order of 80° C. and the surface temperature of the pressure roller 44 is on the order of 50° C. When a user instructs the apparatus to start copying in the stand-by mode, a message "Please wait a while." or the like is displayed on an operation panel or the like. After that, the heater 45 in the heating roller 42 and the heater 47 in the pressure roller 44 are turned on so as to heat the fixing roller 41 and the pressure roller 44, and operations of the printer, copying or the like are started once the surface temperatures thereof reach specified temperatures.

Thick paper has large sheet rigidity and thus has satisfactory curl conditions. Instead, such paper has so much the poorer fixation performance for large sheet volume thereof.

In contrast to that, thin paper has small sheet rigidity and thus has poor curl conditions. Instead, such paper has all the more satisfactory fixation performance for small sheet volume thereof. On condition that copying is started in the stand-by mode, input of thick paper having poor fixation performance as paper sheet still worsens the fixation performance because fixity is originally poor immediately after the start of copying.

When instruction to start copying is given in the stand-by mode in the embodiment, therefore, the mode of the fixing press contact force is controlled according to a type of paper sheet in the warm-up time.

On condition that instruction to start copying is given in the stand-by mode and that thick paper is specified as the type of paper sheet, specifically, the mode of the fixing press contact force is set into the light press contact mode. On condition that thin paper is specified as the type of paper sheet, by contrast, the mode of the fixing press contact force is set into the heavy press contact mode. For the setting of the mode of the fixing press contact force, a selected type of paper sheet is detected on basis of a selection switch on an operation panel that is operated by a user for selection of the type of paper sheet, for instance. As is the case with the first embodiment, subsequently, the target nip width B1, B2 is read from the memory in the control section 14 in accordance with the selected type of paper sheet that is thin paper or thick paper, and a mode of the fixing press contact force is established on basis of the target nip width B1, B2.

Figure 9:
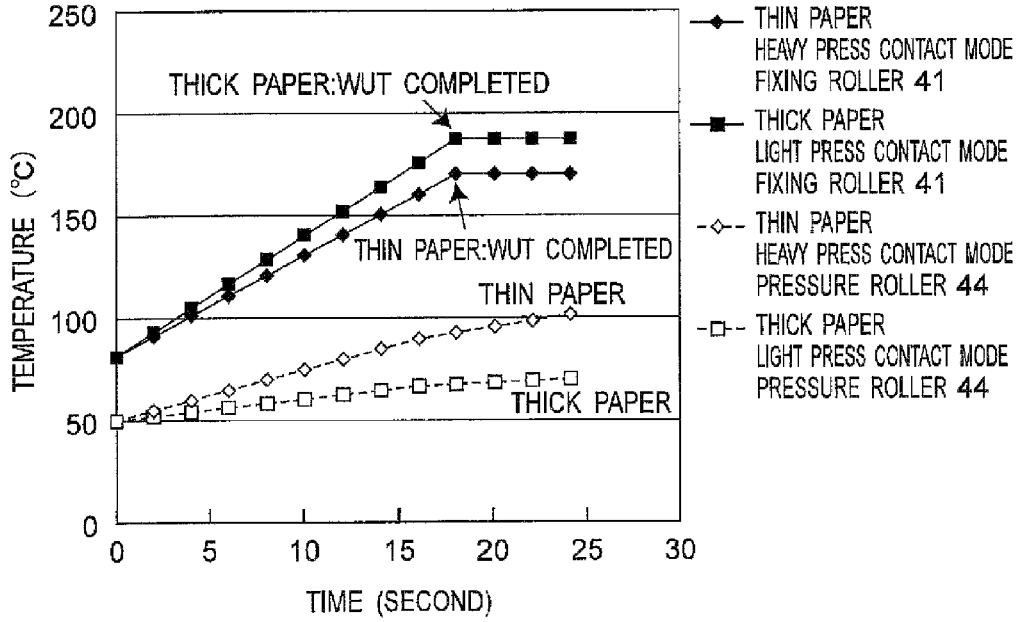
FIG. 9 is a diagram showing change in the surface temperatures of the fixing roller and the pressure roller on occasion when thick paper is used and on occasion when thin paper is used.
Figure 10:
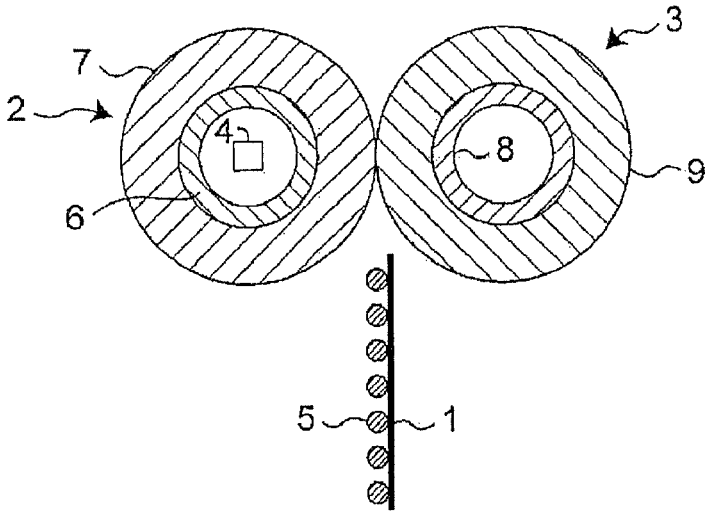
Fig.10 PRIOR ART
FIG. 10 is a schematic sectional view showing a configuration of a conventional two-roller type fixing device.
Figure 11:
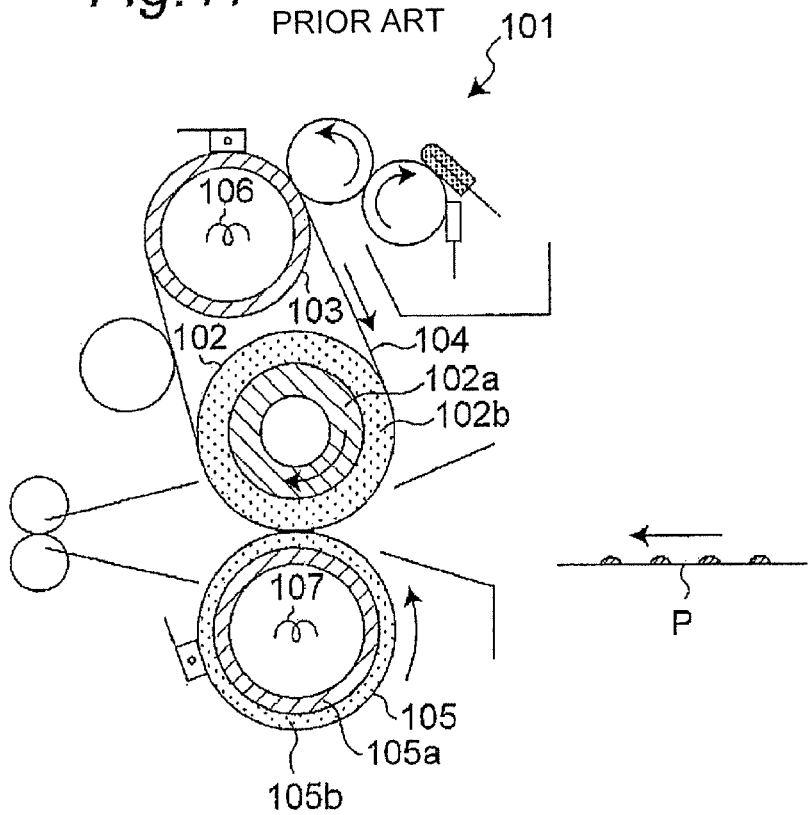
Fig.11 PRIOR ART
FIG. 11 is a schematic sectional view showing a configuration of a conventional three-roller type fixing device.
Figure 12:
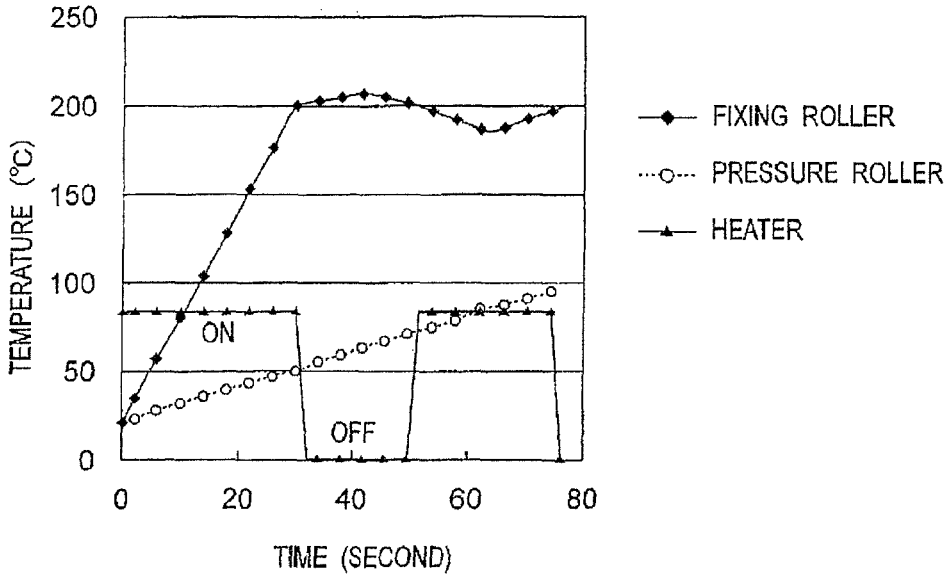
Fig.12 PRIOR ART
FIG. 12 is a diagram showing change with lapse of time in temperature of a heater and surface temperatures of a fixing roller and a pressure roller immediately after power-on in the conventional fixing devices shown in FIGS. 10 and 11.
Figure 13:
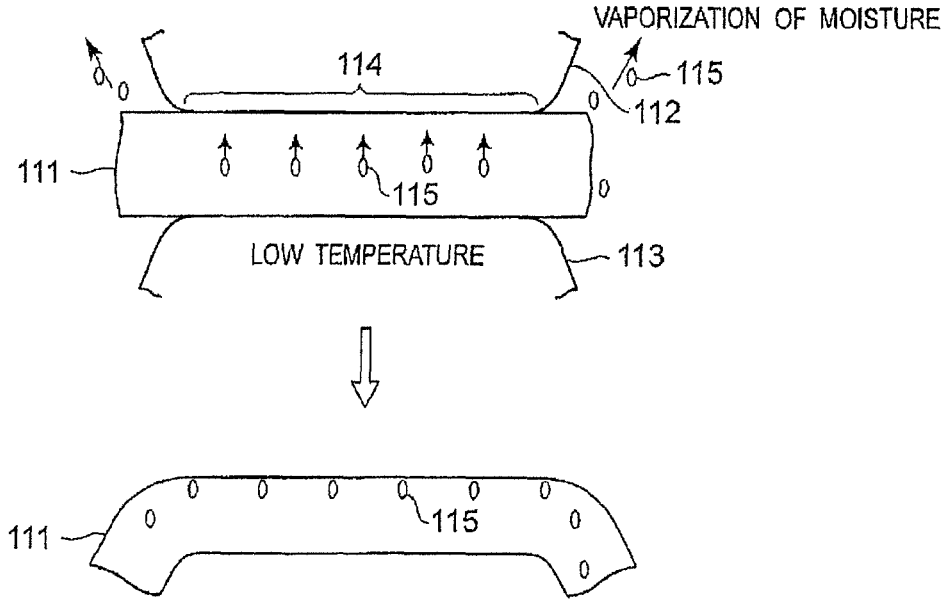
Fig.13 PRIOR ART
FIG. 13 are diagrams showing a mechanism of curl of a paper sheet.
Figure 14:
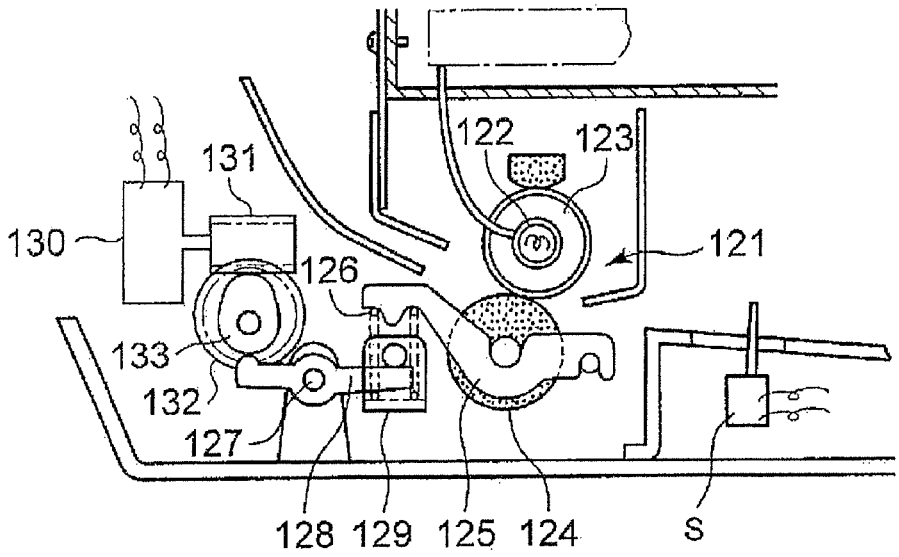
Fig.14 PRIOR ART
FIG. 14 is a sectional view showing a schematic configuration of a fixing unit in a conventional electrostatic recording device in which a mode of fixing press contact force is altered according to type of paper sheet.
Figure 15A:
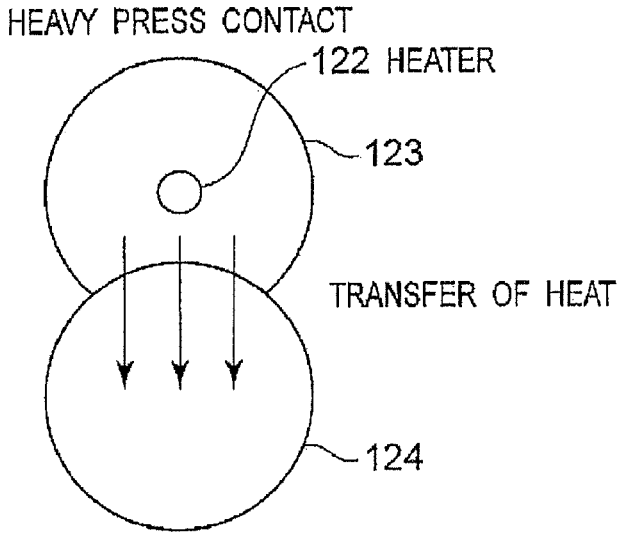
Fig.15A PRIOR ART
FIG. 15A is a diagram showing a mechanism of temperature difference control according to a mode of fixing press contact force (a heavy press contact mode)
Figure 15B:
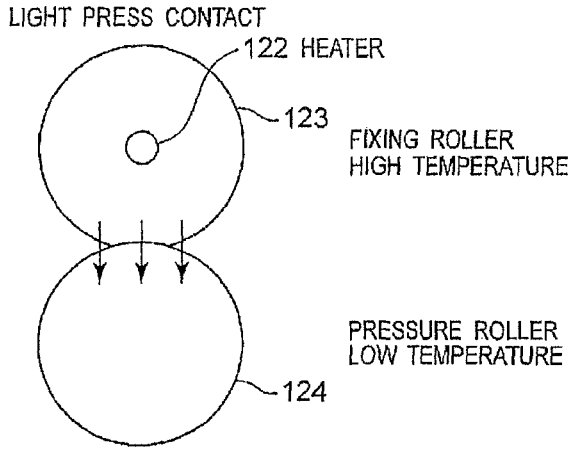
Fig.15B PRIOR ART
FIG. 15B is a diagram showing a mechanism of temperature difference control according to a mode of fixing press contact force (a light press contact mode)
Figure 16:
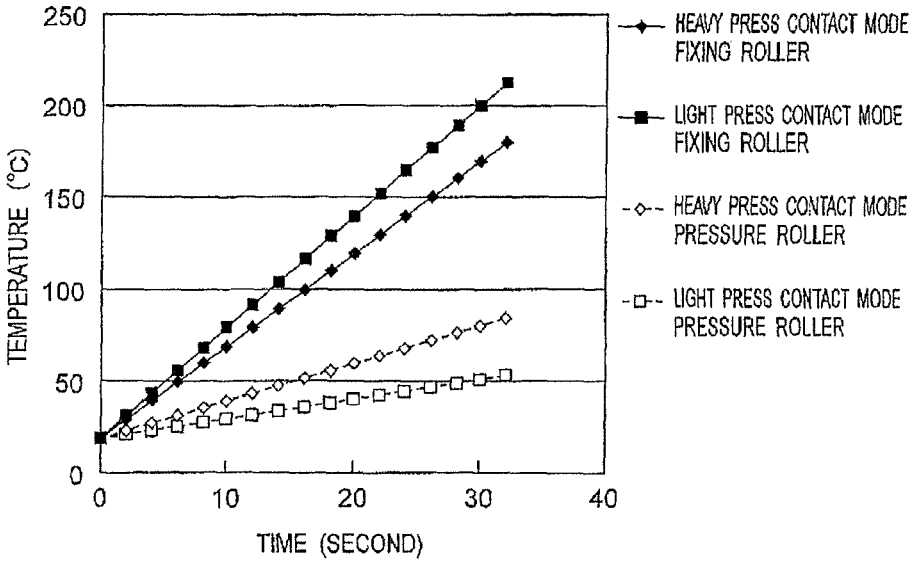
Fig.16 PRIOR ART
FIG. 16 is a diagram showing change in surface temperatures of a fixing roller and a pressure roller in heavy press contact mode and light press contact mode in the conventional fixing unit shown in FIG. 14.

In the stand-by mode, as shown in FIG. 9, the surface temperature of the fixing roller 41 is about 80° C. and the surface temperature of the pressure roller 44 is about 50° C. When a user pushes a copy button, in this state, the heaters 45, 47 are turned on, so that the surface temperatures of the fixing roller 41 and the pressure roller 44 rise. In the embodiment, additionally, the temperatures of the fixing roller 41 and the pressure roller 44 are raised in the light press contact mode on condition that the type of paper sheets which are to be copied is a thick paper, while the temperatures are raised in the heavy press contact mode on condition that the type of paper sheets which are to be copied is a thin paper.

On condition that the type of paper sheets is thick paper, accordingly, the surface temperature of the fixing roller 41 rapidly rises, as in the first embodiment, from about 80° C. at start of the temperature rising to about 185° C. about 18 seconds after that. The temperature of the pressure roller 44, however, rises from about 50° C. at the start of the temperature rising to no more than about 65° C. As a result, the difference between the temperatures of the fixing roller 41 and the pressure roller 44 becomes as large as 120° C. Thick paper, however, has strong rigidity and thus has satisfactory curl conditions, which prevents occurrence of curls. Instead, thick paper has so much the poorer fixation performance for large volume thereof. Because of the mode of the fixing press contact force that has been set to the light press contact mode, however, the surface temperature of the fixing roller 41 is raised to a high temperature of about 185° C. and thus sufficient fixation performance can be attained.

On condition that the type of paper sheets is thin paper, by contrast, the mode of the fixing press contact force is set to the heavy press contact mode. As a consequence, the surface temperature of the fixing roller 41 rises from about 80° C. at start of the temperature rising to about 170° C. and that of the pressure roller 44 rises to about 85° C. Thus, the temperature of the fixing roller 41 rises to no more than about 170° C. and therefore the fixation performance of the fixing section 13 itself is disadvantageous. Thin paper itself, however, offers satisfactory fixation performance because of small volume thereof. In conclusion, satisfactory fixation performance can be obtained. Instead, thin paper has so much the poorer curl conditions for lack of rigidity. Because of the mode of the fixing press contact force that has been set to the heavy press contact mode, however, the difference between the temperatures of the fixing roller 41 and the pressure roller 44 is as small as 85° C., and the fixing section 13 itself provides satisfactory curl conditions. As a result, occurrence of curls is prevented.

By above control, cancellation of the mode of the fixing press contact force, return to the normal press contact mode, and start of the operations of fixation can be attained with timing of completion of the warm-up time in any case of a thick paper being used or a thin paper being used. This eliminates waiting time till attainment of satisfactory curl conditions of paper sheets after the completion of the warm-up time during which the fixing roller 41 is dominantly heated, and substantially decreases the warm-up time.

Though an example in which instruction to start copying is given in the stand-by mode is described for the embodiment, the embodiment can similarly be applied to an example of start-up in the morning upon power-on.

In the embodiment, namely, satisfactory fixation performance and satisfactory curl conditions of paper sheets can go together even in the stand-by mode or on occasion of power-on to the heater at start-up in the morning or the like.

In the above embodiments, two modes, i.e., the heavy press contact mode and the light press contact mode are presented as an example of the modes of the fixing press contact force. The invention, however, is not limited to the two modes but includes multistage control with three or more modes such as "slightly heavy press contact mode" and "slightly light press contact mode".

As conditions for switching and setting of the mode of fixing press contact force in the above embodiments, environmental temperature and humidity are presented as an example in the first embodiment, and type of paper sheets is presented as an example in the second embodiment. The invention, however, is not limited thereto. The conditions have only to correspond to various factors that involve change in the fixing press contact force, such as "copy mode" and "change with age in image forming apparatus (printer)", for instance. As for "change with age in image forming apparatus (printer)", in particular, the control of the setting to the light press contact mode may be performed on condition that a period of use of the fixing roller/the pressure roller exceeds a specified period. When the fixing roller and the pressure roller that are pregnated with oil for prevention of abnormal image (paper wrinkle, spattering and the like) is used, amount of the oil decreases as they are used. This configuration is disadvantageous to release property and abnormal image but advantageous to fixity. By the setting to the light press contact mode, therefore, abnormal images can be rectified while certain fixation performance is retained.

The invention claimed is:

1. A fixing device comprising:

a heat source, a fixing roller that is heated by heat provided from the heat source and that is rotatable, a pressure roller that is rotatably brought into press contact with a surface of the fixing roller so as to form a nip part and that causes the nip part to fix unfixed toner images, which is formed on a surface of recording medium, onto the recording medium, and a pressure adjusting unit that determines whether a predetermined condition holds or not, and when the condition holds, the pressure adjusting unit adjusts a nip pressure of the nip part between the fixing roller and the pressure roller;

wherein the predetermined condition is that a surface temperature of the fixing roller upon power-on of the heat source is not less than a first specified value or is not more than a second specified value lower than the first specified value.

2. An image forming apparatus comprising:

an image forming unit for forming unfixed toner images of electrified toner on a surface of recording medium, and the fixing device as claimed in claim 1.

3. A fixing device comprising:

a heat source, a fixing roller that is heated by heat provided from the heat source and that is rotatable, a pressure roller that is rotatably brought into press contact with a surface of the fixing roller so as to form a nip part and that causes the nip part to fix unfixed toner images, which is formed on a surface of recording medium, onto the recording medium, and a pressure adjusting unit that determines whether a predetermined condition holds or not, and when the condition holds, the pressure adjusting unit adjusts a nip pressure of the nip part between the fixing roller and the pressure roller;

wherein the predetermined condition is that a surface temperature of the pressure roller upon power-on of the heat source is not less than a first specified value or is not more than a second specified value lower than the first specified value.

4. An image forming apparatus comprising:

an image forming unit for forming unfixed toner images of electrified toner on a surface of recording medium, and the fixing device as claimed in claim 3.

5. A fixing device comprising a heat source, a fixing roller that is heated by heat provided from the heat source and that is rotatable, a pressure roller that is rotatably brought into press contact with a surface of the fixing roller so as to form a nip part and that causes the nip part to fix unfixed toner images, which is formed on a surface of recording medium, onto the recording medium, at least one of a first temperature detecting section for detecting a surface temperature of the fixing roller and a second temperature detecting section for detecting a surface temperature of the pressure roller, and a pressure adjusting unit that adjusts a nip pressure of the nip part between the fixing roller and the pressure roller on basis of at least one of the temperature detected by the first temperature detecting section and the temperature detected by the second temperature detecting section, the first temperature detecting section for detecting the surface temperature of the fixing roller, wherein the pressure adjusting unit adjusts the nip pressure of the nip part so that the nip pressure is lower than a specified nip pressure on condition that the surface temperature of the fixing roller detected by the first temperature detecting section upon power-on of the heat source is not higher than a specified temperature.

6. An image forming apparatus comprising:

an image forming unit for forming unfixed toner images of electrified toner on a surface of recording medium, and the fixing device as claimed in claim 5.

7. A fixing device comprising a heat source, a fixing roller that is heated by heat provided from the heat source and that is rotatable, a pressure roller that is rotatably brought into press contact with a surface of the fixing roller so as to form a nip part and that causes the nip part to fix unfixed toner images, which is formed on a surface of recording medium, onto the recording medium, at least one of a first temperature detecting section for detecting a surface temperature of the fixing roller and a second temperature detecting section for detecting a surface temperature of the pressure roller, and a pressure adjusting unit that adjusts a nip pressure of the nip part between the fixing roller and the pressure roller on basis of at least one of the temperature detected by the first temperature detecting section and the temperature detected by the second temperature detecting section, the first temperature detecting section for detecting the surface temperature of the fixing roller, wherein the pressure adjusting unit adjusts the nip pressure of the nip part so that the nip pressure is higher than a specified nip pressure on condition that the surface temperature of the fixing roller detected by the first temperature detecting section upon power-on of the heat source is not lower than a specified temperature.

8. An image forming apparatus comprising:

an image forming unit for forming unfixed toner images of electrified toner on a surface of recording medium, and the fixing device as claimed in claim 7.

9. A fixing device comprising a heat source, a fixing roller that is heated by heat provided from the heat source and that is rotatable, a pressure roller that is rotatably brought into press contact with a surface of the fixing roller so as to form a nip part and that causes the nip part to fix unfixed toner images, which is formed on a surface of recording medium, onto the recording medium, at least one of a first temperature detecting section for detecting a surface temperature of the fixing roller and a second temperature detecting section for detecting a surface temperature of the pressure roller, and a pressure adjusting unit that adjusts a nip pressure of the nip part between the fixing roller and the pressure roller on basis of at least one of the temperature detected by the first temperature detecting section and the temperature detected by the second temperature detecting section, the second temperature detecting section for detecting the surface temperature of the pressure roller, wherein the pressure adjusting unit adjusts the nip pressure of the nip part so that the nip pressure is lower than a specified nip pressure on condition that the surface temperature of the pressure roller detected by the second temperature detecting section upon power-on of the heat source is not higher than a specified temperature.

10. An image forming apparatus comprising:

an image forming unit for forming unfixed toner images of electrified toner on a surface of recording medium, and the fixing device as claimed in claim 9.

11. A fixing device comprising a heat source, a fixing roller that is heated by heat provided from the heat source and that is rotatable, a pressure roller that is rotatably brought into press contact with a surface of the fixing roller so as to form a nip part and that causes the nip part to fix unfixed toner images, which is formed on a surface of recording medium, onto the recording medium, at least one of a first temperature detecting section for detecting a surface temperature of the fixing roller and a second temperature detecting section for detecting a surface temperature of the pressure roller, and a pressure adjusting unit that adjusts a nip pressure of the nip part between the fixing roller and the pressure roller on basis of at least one of the temperature detected by the first temperature detecting section and the temperature detected by the second temperature detecting section, the second temperature detecting section for detecting the surface temperature of the pressure roller, wherein the pressure adjusting unit adjusts the nip pressure of the nip part so that the nip pressure is higher than a specified nip pressure on condition that the surface temperature of the pressure roller detected by the second temperature detecting section upon power-on of the heat source is not lower than a specified temperature.

12. An image forming apparatus comprising:

an image forming unit for forming unfixed toner images of electrified toner on a surface of recording medium, and the fixing device as claimed in claim 11.

* * * * *